US007352379B2

(12) United States Patent
Narita et al.

(10) Patent No.: US 7,352,379 B2
(45) Date of Patent: Apr. 1, 2008

(54) SHEET FOR FORMING AN IMAGE, IMAGE FORMING METHOD, AND IMAGE FORMING APPARATUS

(75) Inventors: Satoshi Narita, Tokyo (JP); Junichi Hiroi, Tokyo (JP); Kozo Odamura, Tokyo (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 10/809,224

(22) Filed: Mar. 25, 2004

(65) Prior Publication Data

US 2004/0227805 A1 Nov. 18, 2004

(30) Foreign Application Priority Data

Mar. 27, 2003 (JP) ..... 2003-087289

(51) Int. Cl.
*B41J 2/325* (2006.01)

(52) U.S. Cl. ..... 347/177

(58) Field of Classification Search ..... 347/172, 347/174, 215, 176–178; 400/240, 240.1, 400/240.2, 240.3, 240.4, 120.02, 206, 206.2
See application file for complete search history.

(56) References Cited

U.S. PATENT DOCUMENTS 5,978,005 A * 11/1999 Hadley ..... 347/177
5,982,405 A * 11/1999 Sasaki et al. ..... 347/176

FOREIGN PATENT DOCUMENTS

JP 2000-033781 2/2000
JP 2000-033782 2/2000

* cited by examiner

*Primary Examiner*—K. Feggins
(74) *Attorney, Agent, or Firm*—Ladas & Parry LLP

(57) ABSTRACT

The present invention provides a sheet for forming an image having an identifying mark, an image forming method, and an image forming apparatus using the same, wherein the identifying mark is useful to identify various information concerning the sheet. The sheet for forming an image is provided with two or more image-formative layers which are defined by frame respectively and arranged in a longitudinal direction of the sheet. The identifying mark comprises a sequence of mark bits which records the information, and the mark bits are respectively allocated to unit frames each of which comprises a single frame or plural frames of the image-formative layer with the mark bits being arranged in order of the sequence recording the information and repeated at least one cycle period of a certain number of the unit frames along with a longitudinal direction of the sheet for forming an image, wherein the sequence of the mark bits constituting the identifying mark is a combination of a sequence of mark bits constituting a first mark A with a sequence of mark bits constituting a second mark B, the first mark A having a cycle period of a natural number X, the second mark B having a cycle period same as said X or of a natural number Y different from said X and relatively prime with said X.

11 Claims, 6 Drawing Sheets

Mark A with cycle period comprising 3 unit frames

Mark B with cycle period comprising 4 unit frames

Combination of Mark A and Mark B

Sensor output

Mark A with cycle period comprising 3 unit frames
a10
a01
a20
a02
a11
a22
a13
a31
a12
a21
a32
a23
a14
a41

Mark B with cycle period comprising 4 unit frames
b10
b01
b20
b02
b30
b03
b40
b04
b12
b15
b16
b17
b21
b28
etc.

Combination of Mark A and Mark B
output
a10b10
a10b01
a20b20
a20b03
a13b12
a31b15
a32b16
a23b21
a14b04
etc.

Mark K with cycle period comprising 3 unit frames Black mark

Mark L with cycle period comprising 4 unit frames White mark

Combination (Black mark A is layed on White mark B)

Sensor output, in which
Frame ☐ expresses output of White mark

FIG. 4(A) Mark A with cycle period comprising 3 unit frames (a1)
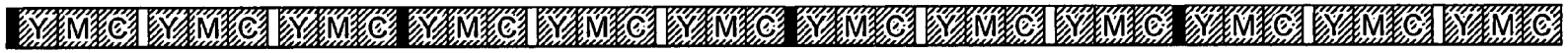
FIG. 4(B) Mark B with cycle period comprising 4 unit frames (b1)
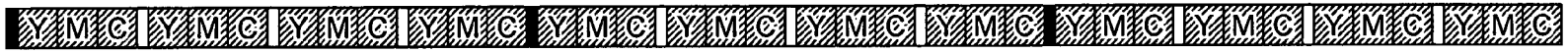
FIG. 4(C) Mark AB with cycle period comprising 12 unit frames (a1b1)
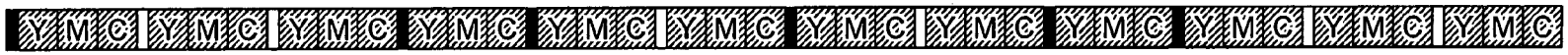
FIG. 4(D) Mark A with cycle period comprising 3 unit frames (a2)
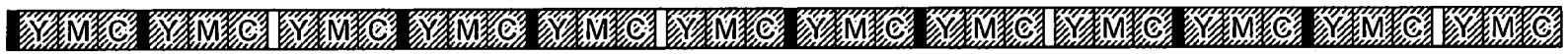
FIG. 4(E) Mark B with cycle period comprising 4 unit frames (b2)
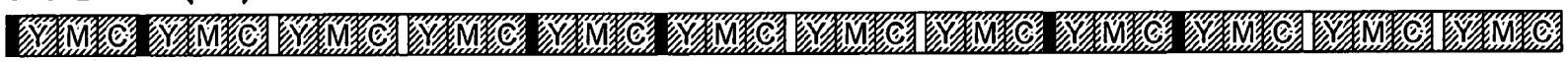
FIG. 4(F) Mark AB with cycle period comprising 12 unit frames (a2b2)
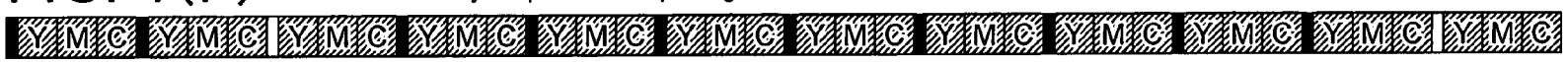

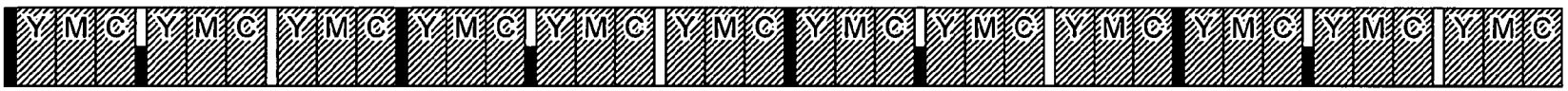
FIG. 5(A) Mark A with cycle period comprising 3 unit frames (a12)
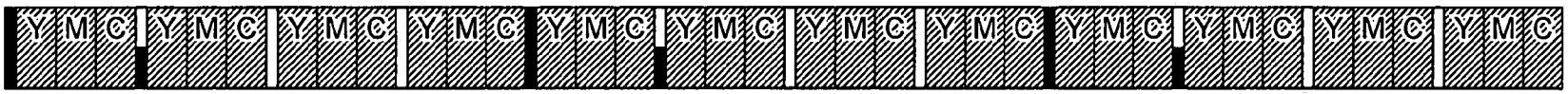
FIG. 5(B) Mark B with cycle period comprising 4 unit frames (b12)
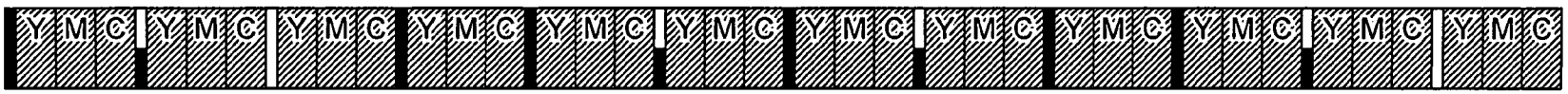
FIG. 5(C) Mark AB with cycle period comprising 12 unit frames (a12B12)
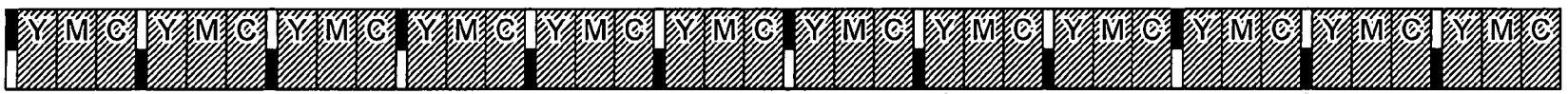
FIG. 5(D) Mark A with cycle period comprising 3 unit frames (a41)
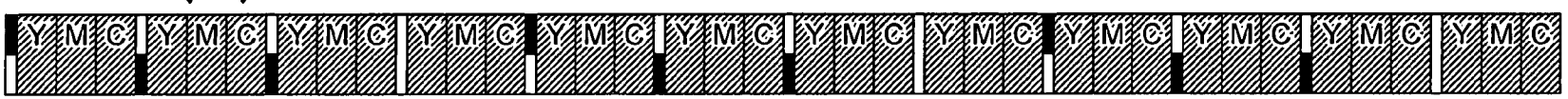
FIG. 5(E) Mark B with cycle period comprising 4 unit frames (b21)
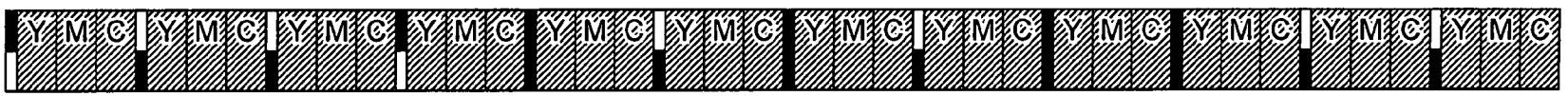
FIG. 5(F) Mark AB with cycle period comprising 12 unit frames (a41b21)

FIG. 6(A) Mark K with cycle period comprising 3 unit frames (k1)
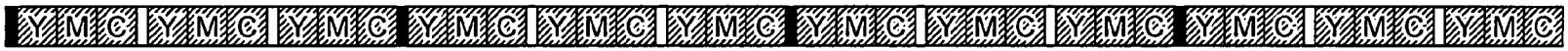
FIG. 6(B) Mark L with cycle period comprising 4 unit frames (l1)
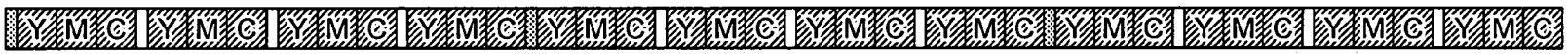
FIG. 6(C) Mark KL with cycle period comprising 12 unit frames (k1l1)
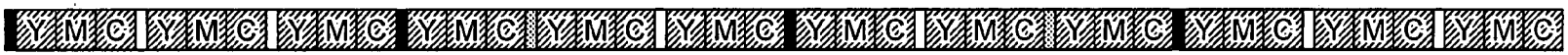
FIG. 6(D) Mark K with cycle period comprising 3 unit frames (k2)
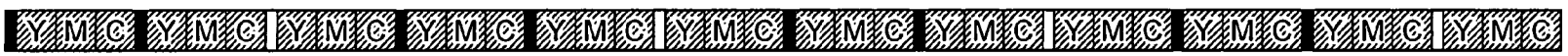
FIG. 6(E) Mark L with cycle period comprising 4 unit frames (l2)
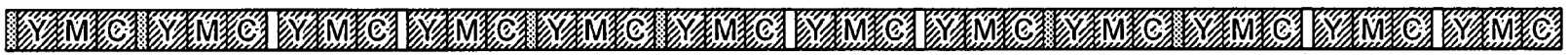
FIG. 6(F) Mark KL with cycle period comprising 12 unit frames (k2l2)
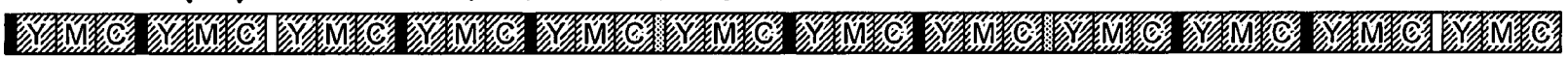

SHEET FOR FORMING AN IMAGE, IMAGE FORMING METHOD, AND IMAGE FORMING APPARATUS

BACKGROUND OF THE INVENTION

1. Field of the Invention

The present invention relates to a sheet for forming an image provided with a mark which can identify information concerning the sheet for forming an image, for instance, manufacturers, distributors, product lines, availability of product, product forgery or the like (hereinafter referred as an "identifying mark"), an image forming method and an image forming apparatus using the sheet for forming an image.

2. Description of the Related Art

Conventionally, as an image forming method for making hard copies of images in forms of video images, digital photographs or the like, there is a thermal transfer recording method. In an image forming process using the thermal transfer recording method, an image is printed by transferring a colorant from a thermal transfer sheet to a thermal transfer image-receiving sheet using a thermal head mounted on a printer (image forming apparatus) so that a desired image is obtained.

In the thermal transfer recording method, generally printing is carried out by using a thermal transfer sheet having a combination of some colorant layers, for example, three primary colors of yellow, magenta and cyan, and if necessary, colorants of black or so called special colors (namely, specially prepared exclusive colors) such as a metallic color, a fluorescent color or the like in order to form a full color image such as a video image, a digital photograph or the like.

Normally, a thermal transfer sheet often comprises a long substrate film made of polymeric resin such as polyethylene terephthalate or the like and colorant layers comprising aforementioned colorants disposed thereon in a manner that the colorant layers are provided alternately (it is called "alternately provided side by side") and repeatedly in a certain form and distance. For the purpose of protecting an image obtained by printing, the thermal transfer sheet may be provided with a thermally transferable protect layer adjacent to the colorant layer of the substrate. Other thermally transferable layers than the colorant layer and the protect layer may be formed on the thermal transfer sheet.

Moreover, an image may be formed by using a combination of plural kinds of monochrome thermal transfer sheets, each of which has a colorant layer of single color on the whole surface.

Generally, a size and a form per frame of a thermally transferable layer formed on a thermal transfer sheet are often determined in accordance with a thermal transfer image-receiving sheet used in combination with the thermal transfer sheet and a size and a form of a desired image.

A type of thermal transfer sheet used for one kind of printer is not always one type but it varies according to the size (for instance, postcard size, A5 or A4 size, or the like), presence of a protect layer, presence and sort of a special color, and sort of thermal transfer image-receiving sheet used in combination with the thermal transfer sheet.

Further, there are cases that plural distributors sell printers of same model under different product names, and equivalent thermal transfer sheets used for the printers may be given different product names by those distributors.

Therefore, in the case that a printer accepts various kinds of thermal transfer sheets, the identification of types of thermal transfer sheets is a substantive issue. Generally, a different printing mode for each type of thermal transfer sheet is set to a printer. If a wrong mode is selected, a predetermined printing performance and durability cannot be obtained. Moreover, there is even a possibility of causing a printer trouble or a malfunction in printing operation.

Conventionally, identification of type of a thermal transfer sheet is carried out in such a manner that an user confirms written type of a thermal transfer sheet, and then the user input the type in a printer or another printing controller such as a personal computer.

There is also known a method that a printer acknowledges an identification mark provided on a thermal transfer sheet, thereby the printer automatically identifies a type of the thermal transfer sheet and selects an appropriate setting (Japanese Patent Application Laid-open (JP-A) No. 2000-33781 and JP-A No. 2000-33782). In such a method using the identification mark, there is a case that a printer simultaneously confirms presence of a thermal transfer sheet.

SUMMARY OF THE INVENTION

However, in aforementioned conventional method wherein an user identifies a type of product and input it in a printer, there is a possibility of human error and lacks reliability.

On the other hand, in the method wherein a printer automatically identifies an identifying mark, generally a colored mark is often provided on a part where the mark does not influence printing of a thermal transfer sheet, for instance, a blank space between portions wherein colorants of each color are provided. However, forms and kinds of the conventional identifying marks are limited, hence, there is a limit in identifying the above mentioned various thermal transfer sheets.

In view of the above mentioned problems, an object of the present invention is to provide a sheet for forming an image provided with an identifying mark, wherein the mark can identify various information concerning the sheet for forming an image, for example, manufacturers, distributors, product lines, availability of product, product forgery or the like, and wherein the mark is effectively capable of carrying design as well as having identification ability. The object of the present invention is also to provide an image forming method and an image forming apparatus using the sheet for forming an image.

In order to attain the above object, the present invention provides a sheet for forming an image comprising a substrate film and two or more image-formative layers disposed thereon, the image-formative layers being defined by frame respectively and arranged in a longitudinal direction of the substrate film, wherein an identifying mark comprising a sequence of mark bits which records information concerning the sheet for forming an image is provided to the sheet for forming an image in a manner of allocating respective mark bits to unit frames each of which comprises a single frame or plural frames of the image-formative layer with the mark bits being arranged in order of the sequence recording the information with at least one cycle period comprising a certain number of the unit frames along with a longitudinal direction of the sheet for forming an image, and wherein the sequence of the mark bits constituting the identifying mark is a combination of a sequence of mark bits constituting a first mark A with a sequence of mark bits constituting a second mark B, the first mark A having a cycle period of a natural number X, the second mark B having a cycle period same as said X or of a natural number Y different from said X and relatively prime with said X, and the first mark A and the second mark B being different from each other.

In the above mentioned sheet for forming an image, the identifying mark may be an optically detectable mark, and the first mark A and the second mark B may have different optical property for detection.

The sequence of mark bits constituting the identifying mark may be a combination of the sequence of mark bits constituting the first mark A, the sequence of mark bits constituting the second mark B, and a sequence of mark bits constituting a third mark C, the third mark C having a cycle period same as the natural numbers X and/or Y or of a natural number Z different from said X and/or Y and relatively prime with said X and Y, and the first mark A, the second mark B and the third mark C being different from each other.

Further, the sequence of mark bits constituting the identifying mark may be a combination of at least three sequences of mark bits including those of the mark A and the mark B, each of the sequences constituting a separate series of mark from each other, wherein each mark has a cycle period of a natural number same as any one of the other mark or of a natural number different from every one of the other mark and relatively prime with each other, and the all the marks are different from each other in sequence.

An image forming method of the present invention comprises steps of:

detecting an identifying mark of the sheet for forming an image of the present invention; and identifying the sheet for forming an image based on a detecting result of the detecting step.

In the above mentioned method, the detecting step may be carried out in such manner that at least one cycle of the mark bits of the identifying mark are detected while carrying the sheet for forming an image to a forward or a reverse direction.

An image forming apparatus of the present invention comprises:

a means for detecting an identifying mark of the sheet for forming an image of the present invention; and a means for identifying the sheet for forming an image based on a detecting result of the detecting step.

In the above mentioned apparatus, the means for detecting the mark bits may be intended so as to detect at least one cycle of the mark bits of the identifying mark while carrying the sheet for forming an image to a forward or a reverse direction.

BRIEF DESCRIPTION OF THE DRAWINGS

In the accompanying drawings,

FIG. 4 is a schematic view showing a thermal transfer sheet of a first embodiment of the present invention;

FIG. 5 is a schematic view showing a thermal transfer sheet of a second embodiment of the present invention; and FIG. 6 is a schematic view showing a thermal transfer sheet of a third embodiment of the present invention.

Figure 1A:
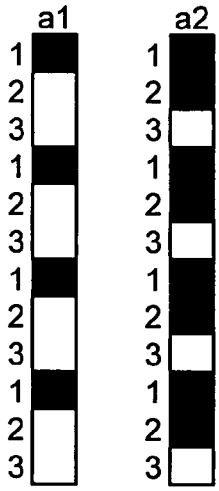
FIG. 1 is a simplified schematic view showing a repeating pattern of an identifying mark on a thermal transfer sheet of the present invention.

The signs in each figure refer to the following:

A, B, AB, K, L, KL: mark

DETAILED DESCRIPTION OF THE PREFERRED EMBODIMENTS

In the present invention, an identifying mark is applied to a sheet for forming an image having two or more image-formative layers, which are defined by frame respectively and arranged on a substrate film. In the typical case, the substrate film to be used is a long substrate film, and the image-formative layers in the frame-form are arranged in a longitudinal direction of the substrate film. As a sheet for forming an image, there may be a sublimation type or heat melting type thermal transfer sheet.

The image-formative layers defined by frame respectively and arranged in a longitudinal direction of the substrate film are layers useful for forming an image on image-receptive media. There may be a transferable layer alternately provided side by side on a sublimation type or heat melting type thermal transfer sheet, which includes not only an image-expressing layer such as a colorant layer of each color of YMC or the like but also any of layers for assisting image formation such as a transferable protect layer and a transferable primer layer.

The identifying mark of the present invention provided on a sheet for forming an image is a mark comprising a sequence composed of two or more distinguishable mark bits which records information concerning the sheet for forming an image. The mark bits constituting the identifying mark is provided to the sheet for forming an image in a manner of allocating respective mark bits to unit frames of the image-formative layer at a rate of one mark bit per one unit frame with the mark bits being arranged in predetermined order for recording the information and along with a line of the image-formative layers which are alternately arranged side by side in a longitudinal direction of the sheet for forming an image.

The term "unit frame" of the image-formative layer means a single frame or plural frames which serve as a clump to be provided with the individual mark bit constituting an identifying mark. For example, when three colorant layers of YMC are serially and repeatedly arranged on a substrate film, mark bits may be allocated for every frame considering each frame of YMC as a unit frame (that is to say, there is one frame constituting a unit frame), while mark bits may be allocated for every three frames comprised of YMC considering a group of YMC as a unit frame (that is to say, there are three frames constituting a unit frame).

"Allocating respective mark bits to unit frames" means providing a mark bit to a corresponding unit frame. The mark bit is typically provided on a sheet for forming an image so as to be positioned in the blank space in the vicinity of the corresponding unit frame or a location where the corresponding unit frame starts.

The aforementioned identifying mark is allocated by a cycle period of a sequence comprising a predetermined number of mark bits, and it may be allocated with only one cycle or repeatedly allocated two or more cycles in so far as the unit frames continue. Though the cycle of the identifying mark usually starts from a forefront row of the line of unit frames, it may start from a halfway of the line of unit frames, such as a second row or a third row on the line in so far as the detection device can work regardless of a starting position of the identifying mark.

In this way, the identifying mark having a cycle period of a certain number of frames is provided, wherein the length of the cycle period is multiplication product of number of mark bits constituting one cycle period of the identifying mark and number of frames constituting a unit frame. For instance, if there are 12 mark bits constituting one cycle period of an identifying mark and 3 frames comprised of YMC constituting a unit frame, the length of one cycle period will be 12×3=36 frames.

The identifying mark of the present invention is synthesized by combining two or more series of marks. More specifically, the sequence of the mark bits constituting the identifying mark is a combination of two or more sequences of mark bits, each of which has a different sequence from each other and can individually serve for an mark even by itself. Most simple example is a combination of two marks, in which the sequence of the mark bits constituting the identifying mark is a combination of a sequence of mark bits constituting a first mark A with a sequence of mark bits constituting a second mark B, wherein the first mark A has a cycle period of a natural number "X", the second mark B has a cycle period same as said X or of a natural number "Y" different from said X and relatively prime with said X, and the first mark A and the second mark B are different in their sequence from each other. The numbers of "X" and "Y" can be optionally selected in so far as they are relatively prime with each other.

Here, "a natural number Y is relatively prime with a natural number X" means two integer numbers do not have a common divisor except a natural number "1". Hence, the length of the cycle period of the identifying mark is multiplication product of number of mark bits constituting a cycle period of the first mark A, number of mark bits constituting a cycle period of the second mark B and number of frames constituting a unit frame (X×Y×number of frames constituting a unit frame). For example, if there are 3 mark bits constituting a cycle period of the first mark A, 4 mark bits constituting a cycle period of the second mark B and 3 frames comprised of YMC constituting a unit frame, the length of one cycle period will be 3×4×3=36 frames.

The sequence of mark bits of the first mark A and the sequence of mark bits of the second mark B may be combined in accordance with a certain predetermined rule to synthesize a new sequence, which can serves as the identifying mark of the present invention. For example, in the case that a signal represented by a mark bit is a binary data (0 or 1), a combination data (A, B) can be defined as one of the following functions.

(1) Binary notation $$(0,0)=(1,1)=0,\ (1,0)=(0,1)=1$$

(2) One or both of "A" and "B" is 1, 1 is derived $$(0,0)=0,\ (1,0)=(0,1)=(1,1)=1$$

(3) A combination of "A" and "B" is simply derived $$(0,0),\ (1,0),\ (0,1),\ (1,1)$$

If an identifying mark having a specific repeating pattern is allotted to a particular type of the sheet for forming an image, it is possible to allot the identifying mark on same number of types as the number of possible repeating pattern. As the result, various types of the sheets can be identified by identifying marks.

The first mark A and the second mark B can take several different repeating patterns from their own cycle period. Therefore, the identifying mark can provide remarkably various repeating patterns by combining any repeating patterns selected from several sequences of mark bits constituting the first mark A and several sequences of mark bits constituting the second mark B respectively.

The identifying mark can be used for identifying various information concerning a sheet for forming an image. For example, the identifying mark may be used for identifying not only types of product but also manufacturers, distributors, presence of product (judging presence of the sheet mounted on a printer) and product forgery. The identifying mark may have multiple identification information for identifying two or more items among them. Also, it may be used for providing a particular design on a sheet for forming an image if an identifying mark is intended for providing design as well as for identifying product forgery, in such a case that a hologram image is used as the identifying mark.

Next, a sheet for forming an image of the present invention will be explained in more detail. To simplify the explanation, a thermal transfer sheet to be used in the sublimation type thermal transfer recording method is taken as an example, but the present invention may not be limited.

As each material to produce the thermal transfer sheet according to the present invention, namely a substrate sheet, a rear layer, a colorant transferable layer, a protect layer or the like, materials used for a conventional thermal transfer sheet can be effectively used (for instance, materials disclosed in JP-A No. 2000-33781 and JP-A No. 2000-33782).

Material For Mark

The mark to be used in the present invention may be formed in such a manner that a colorant having optical property such as absorbability or reflectiveness of a light radiated from a light source is mixed with a binder resin, a solvent, and if required an additive, and dispersed to prepare a mark ink; the mark ink thus obtained is printed at a predetermined location of a thermal transfer sheet in a predetermined form and size using various printing methods such as gravure printing, screen printing, offset printing or the like; and the printed ink is then dried.

In some cases, a thermal transfer sheet having a thermal transferable layer made of a mark ink is prepared whereby the thermal transferable layer is transferred to the sheet for forming the image so as to form a mark at a predetermined location in a predetermined form and size by a thermal transfer method using a heat source such as a thermal head or the like.

The methods described herein are examples merely showing a part of various ways, and the method to form the mark is not limited to such examples.

Mark Forming Pattern

The identifying mark of the present invention is provided in a cycle period of a certain number of frames and comprised of a combination of the first mark A and the second mark B, wherein the length of the cycle period of the first mark A is multiplication product of a natural number X and number of frames constituting a unit frame (X×number of frames constituting a unit frame), and wherein the length of the cycle period of the second mark B is multiplication product of a natural number Y different from said X and relatively prime with said X and number of frames constituting a unit frame (Y×number of frames constituting a unit frame). Hereinafter, the present invention will be described taking the case of "X=3, Y=4, number of frames constituting a unit frame=1 frame " as an example.

FIG. 1 is a simplified schematic view of one example of a repeating pattern of an identifying mark of a thermal transfer sheet according to the present invention. In the drawing, a black portion represents where the mark exists (the mark bit corresponding to "1" of binary data).

If X=3, that is the case when a first mark A has a cycle period of 3 frames, as shown in FIG. 1(A), there are two different mark providing patterns a1 and a2.

Figure 1B:
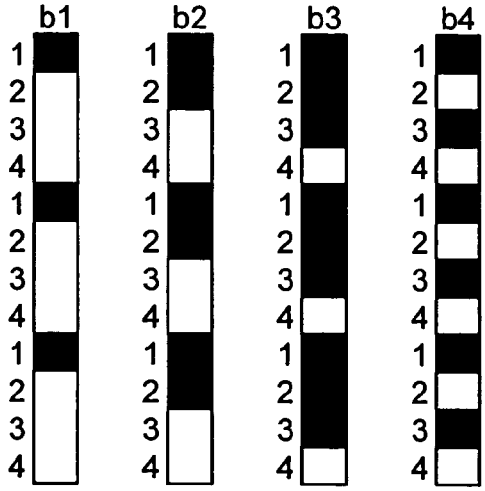

Similarly, if Y=4, that is the case when a second mark B has a cycle period of 4 frames, as shown in FIG. 1(B), there are three mark providing patterns b1, b2 and b3 having cycle periods of 4 frames, and there is a mark providing pattern b4 having a cycle period of 2 frames.

Provided that an output signal of a sensor detecting a presence of an identifying mark is 1 and an absence portion of the identifying mark is 0, the output signal when the sensor detects a thermal transfer sheet having the first mark A of repeating pattern a1 will be a repeating pattern of "100100100100 . . . ."

Similarly, in the case of a thermal transfer sheet having the second mark B of repeating pattern b1, the output signal will be a repeating pattern of "100010001000 . . . ."

In the case of a thermal transfer sheet having a combination of said first mark A and said second mark B, the output signal will be a cycle period of 12 frames with a repeating pattern of "100110101100 . . . ."

Figure 1C:
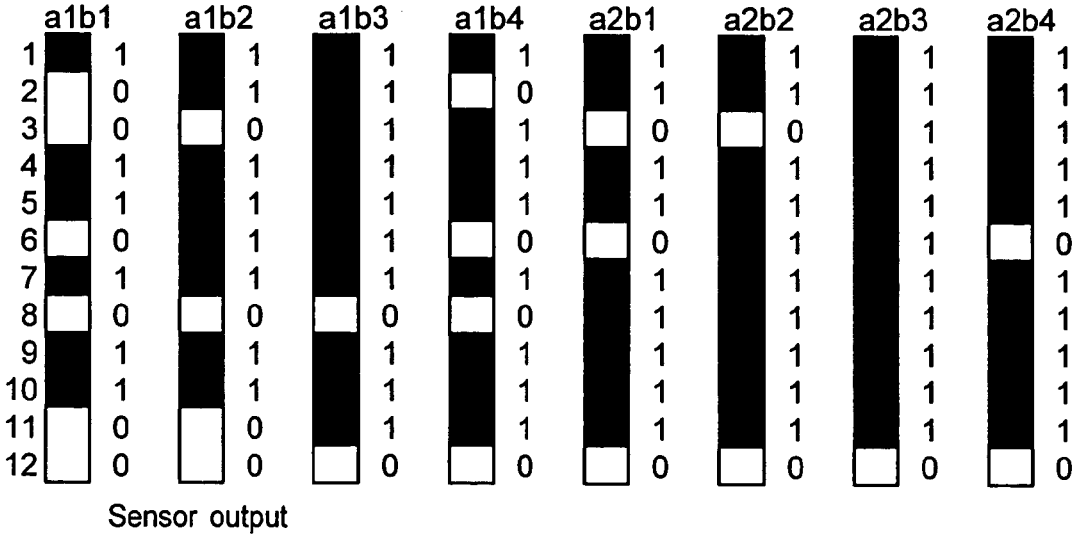

The first mark A has 2 different repeating patterns and the second mark B has 4 different repeating patterns, therefore, by making combinations of the first mark A and the second mark B, it is possible to obtain different combinations of "2×4=8 kinds" as shown in FIG. 1(C).

Specifically, it is possible to allocate identifying marks of different repeating patterns to up to 8 kinds of thermal transfer sheets. Identification of product types can be carried out in such a manner that: the specific repeating patterns are memorized in a printing-control part such as a controller in printer or a computer which operates a printer as key information of type identification; an actual repeating pattern of the mark on a thermal transfer sheet is detected by a sensor (detecting process, detecting means); and the detected pattern is matched with the memorized patterns (identifying process, identifying means) to identify the product type.

If the controller or computer is set to select a suitable printing mode for the detected product type automatically, it is possible to prevent mis-operation due to aforementioned human error.

Further, scanning a repeating pattern of an identifying mark is carried out by taking up and rewinding necessary number of frames upon turning on a printer or an initial operation after switching a thermal transfer sheet. If something is wrong with scanning of product type due to a wrong combination of a loaded thermal transfer sheet and thermal transfer image-receiving sheet or a repeating pattern which is primarily not supposed, a display of the printer or the computer may show the information on the situation and urge the operator to take an appropriate action.

If it is necessary to identify various types of thermal transfer sheets, the following method can be taken to increase repeating patterns and combinations thereof according to the needs.

(1) Providing Plural Mark Bits for Every One Repeating Unit

Figures 2A, 2B, 2C:
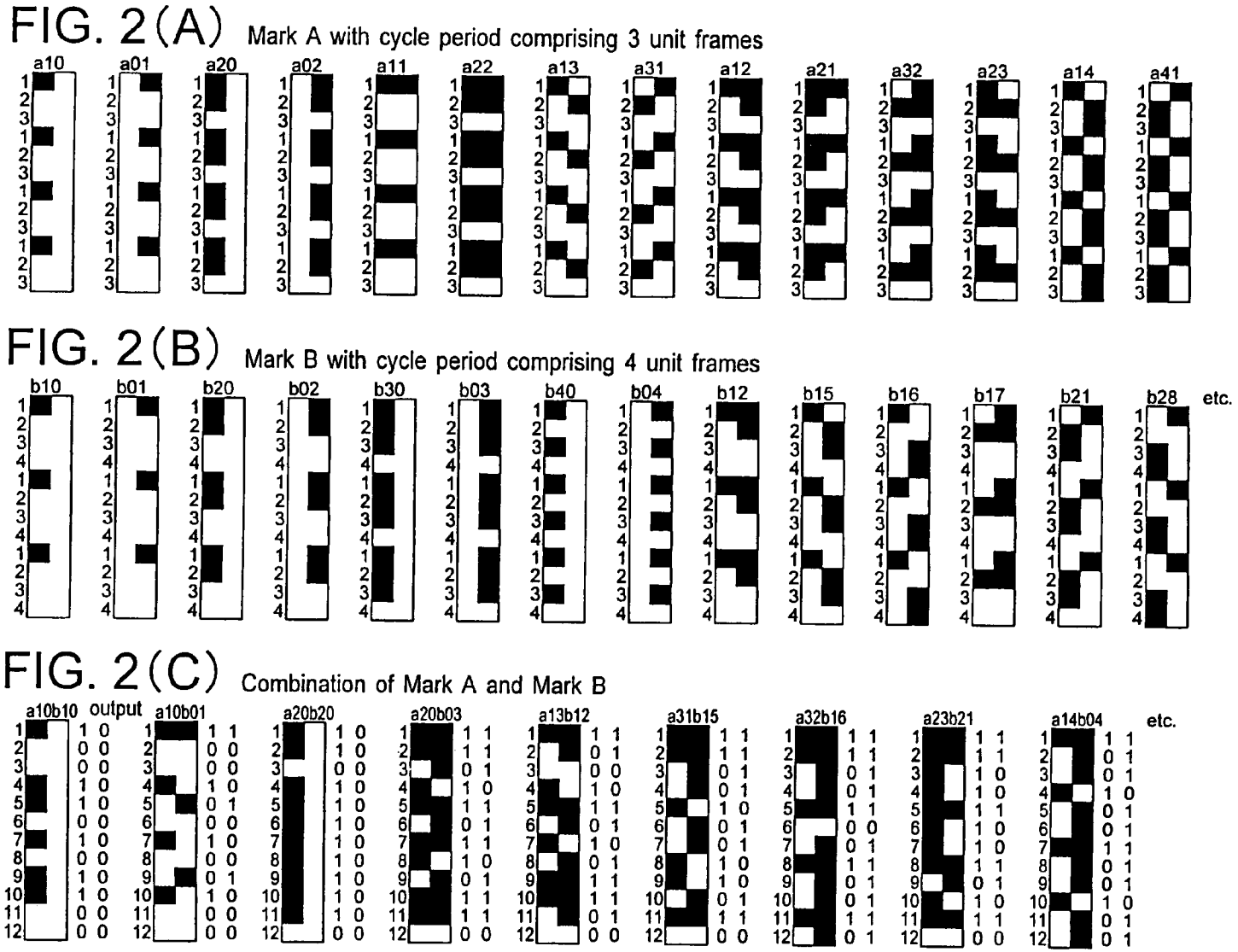
FIG. 2 is a simplified schematic view showing the case that a repeating pattern of an identifying mark is formed on a thermal transfer sheet of the present invention by arranging mark bits of two marks in parallel along with a line of unit frames.

FIG. 2 shows a simplified schematic view of the case in which two mark bits are provided for every one repeating unit of a thermal transfer sheet of the present invention by picking each bit up from different series of mark.

It is possible to increase number of combination in such a manner that a first mark A and a second mark B which have same cycle period but different in sequence of mark bits from each other are combined to use, and mark bits in which one is picked up from the first mark A and the other is picked up from the second mark B are printed in pairs for every unit frame.

FIG. 2 does not show all the combinations, thus there are more combinations existing besides them.

(2) Using Mark Bits Different in Optical Properties

Figure 3A:
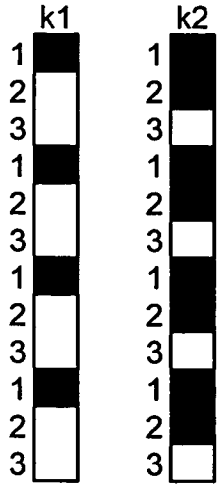
FIG. 3 is a simplified schematic view showing the case of combining marks different in color of a thermal transfer sheet of the present invention.
Figure 3B:
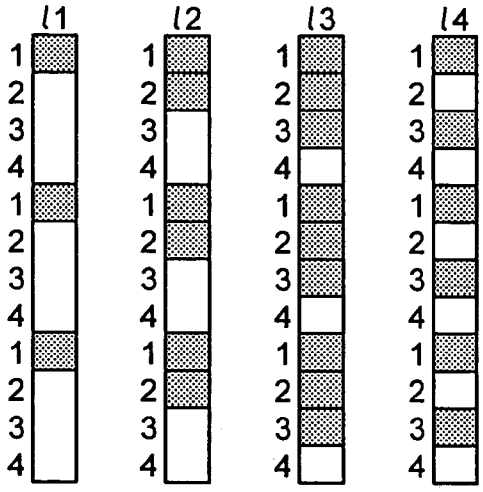
Figure 3C:
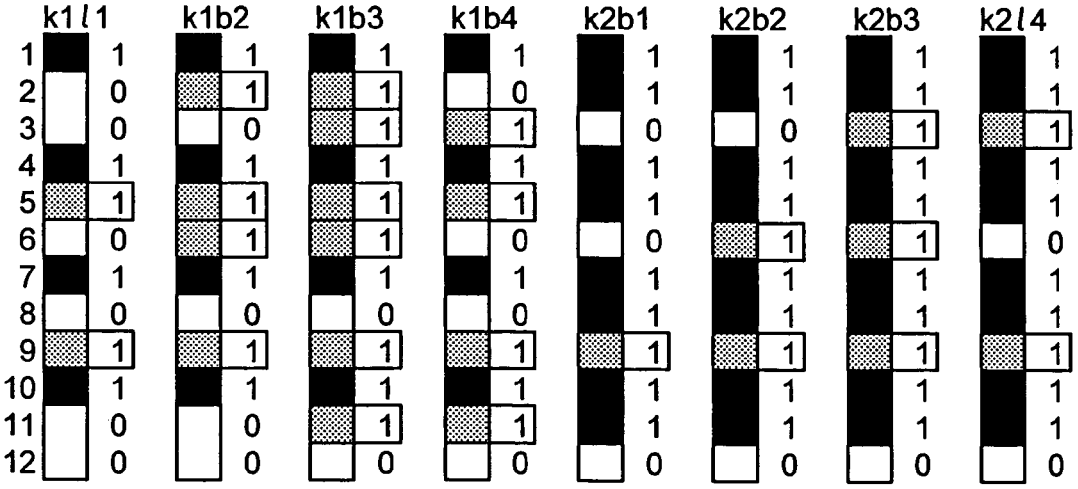

FIG. 3 shows a simplified schematic view of the case in which optically detectable mark bits of different colors are combined to form identifying marks.

Even if their repeating patterns are same in terms of binary data, number of combinations can be increased by forming the first mark A and the second mark B with the use of different colorants.

For example, generally, a mark is printed using a black colorant such as carbon black or the like and often detected by a transparent type sensor (the sensor is comprised of a combination of a light source radiating visible light or infrared light and a detector located facing the light source, wherein the mark absorbs the light radiated by the light source to interrupt, thus the detector detects the presence of the mark when it does not sense the light). However, the mark may be printed using a white colorant such as titanium oxide or the like, and in this case, it is possible to sense the mark by a reflecting type sensor (the sensor is comprised of a combination of aforementioned light source and a detector located adjacent thereof, wherein the mark reflects the light radiated by the light source, thus the detector detects the presence of the mark when it senses the light).

(3) Increasing Marks Having Different Sequence of Mark Bits

It is possible to increase number of combinations in such a manner that the sequence of mark bits constituting the identifying mark is a combination of the sequence of mark bits constituting the first mark A, the sequence of mark bits constituting the second mark B, and a sequence of mark bits constituting a third mark C, wherein the third mark C has a cycle period same as the natural numbers "X" of the first mark A and/or "Y" of the second mark B or of a natural number "Z" different from said "X" and/or "Y" and relatively prime with said "X" and "Y", and the first mark A, the second mark B and the third mark C are different from each other in terms of sequence of mark bits.

The third mark C may have a different cycle period from the first mark A and the second mark B.

Further, if necessary, by adding two or more kinds of the third mark C having different sequences of mark bits with the same or different cycle periods, it is possible to increase number of combinations without limit. However, if a thermal transfer sheet is produced by gravure printing, generally, a special gravure plate core only for printing marks is required. It means that the same number of special gravure plate cores for printing marks is necessary if number of marks different in cycle period is increased. Therefore, it is not appropriate to increase too many marks different in cycle period. Number of the mark is preferably three at most.

Any of the above methods (1), (2), (3) may be used singly or in combination therewith in accordance with the required number of combination.

EMBODIMENTS

Hereinafter, the present invention will be explained in more detail in reference to drawings.

Embodiment 1

FIG. 4 is a schematic view showing a first embodiment of the thermal transfer sheet of the present invention.

A thermal transfer sheet of Example 1 is comprised of a substrate sheet, thermal transfer layers Y, M and C, and an identifying mark AB made of a combination of a series of mark A and a series of mark B.

FIGS. 4(A), 4(B) and 4(C) show a thermal transfer sheet having a mark AB (a1b1) synthesized by combination of a mark A (a1) and a mark B (b1), in which a cycle period of the mark A (a1) is 3 unit frames, a cycle period of the mark B (b1) is 4 unit frames, a cycle period of the mark AB (a1b1) is 12 unit frames (that is, a cycle period of 36 frames).

Further, FIGS. 4(D), 4(E) and 4(F) show a thermal transfer sheet having mark AB (a2b2) with 12 unit frames of cycle period (that is, 36 frames per cycle) which is synthesized by combination of a mark A (a2) whose cycle period is 3 unit frames but in different pattern from the mark A (a1) and a mark B (b2) whose cycle period is 4 unit frames but in different pattern from the mark B (b1).

By combining the mark A and the mark B different in sequence of mark bits from each other, it is possible to provide a large number of identifying marks with different combination patterns.

According to Embodiment 1, various combinations can be obtained as representatively shown in FIG. 1.

Embodiment 2

FIG. 5 is a schematic view showing a thermal transfer sheet of a second embodiment of the present invention.

A thermal transfer sheet of embodiment 2 is comprised of a substrate sheet, thermal transfer layers Y, M and C, and a mark AB made of a combination of a series of mark A and a series of mark B.

FIGS. 5(A), 5(B) and 5(C) show a thermal transfer sheet having a mark AB (a1b1) synthesized by combination of a mark A (a12) and a mark B (b12), in which a cycle period of the mark A (a12) is 3 unit frames, a cycle period of the mark B (b12) is 4 unit frames, a cycle period of the mark AB (a12b12) is 12 unit frames.

Further, FIGS. 5(D), 5(E) and 5(F) show a thermal transfer sheet having mark AB (a41b21) with 12 unit frames per cycle which is synthesized by combination of a mark A (a41) whose cycle period is 3 unit frames but in different pattern from the mark A (a12) and a mark B (b21) whose cycle period is 4 unit frames but in different pattern from the mark B (b12).

By combining the mark A and the mark B different in sequence of mark bits, it is possible to provide a large number of identifying marks with different combination patterns.

According to the Embodiment 2, various combinations can be obtained as representatively shown in FIG. 2.

Embodiment 3

FIG. 6 is a schematic view showing a thermal transfer sheet of a third Embodiment of the present invention.

A thermal transfer sheet of Embodiment 3 is comprised of a substrate sheet, thermal transfer layers Y, M and C, and an identifying mark AB made of a combination of a series of mark A and a series of mark B.

FIGS. 6(A), 6(B) and 6(C) show a thermal transfer sheet having a mark KL (k111) synthesized by combination of a mark K (k1) and a mark L (l1) having a color different from the mark K, in which a cycle period of the mark K (k1) is 3 unit frames, a cycle period of the mark L (l1) is 4 unit frames, a cycle period of the mark KL (k1l1) is 12 unit frames.

Further, FIGS. 6(D), 6(E) and 6(F) show a thermal transfer sheet having mark KL (k1l1) with 12 unit frames per cycle which is synthesized by combination of a mark K (k2) whose cycle period is 3 unit frames but in different pattern from the mark K (k1) and a mark L (l2) whose cycle period is 4 unit frames but in different pattern from the mark L (l2).

By combining mark K and mark L different in colors and patterns, it is possible to provide a large number of marks with different combination patterns.

According to Embodiment 3, various combinations can be obtained as representatively shown in FIG. 3.

Embodiment 4

When mark C whose cycle period is 5 unit frames is added to the combination shown in the Embodiment 1, it is possible to obtain mark ABC whose cycle period is 3 unit frames×4 unit frames×5 unit frames=60 unit frames. In this case, one unit frame comprises 3 frames of YMC, thus, it is a cycle period of 180 frames.

In this way, in addition to the above described embodiments, it is possible to obtain thermal transfer sheets of even more combination patterns.

As described above in detail, according to the present invention, it is possible to identify various information, for instance, manufacturers, distributors, product lines, availability of product, product forgery or the like by providing a mark which is large in number of cycle period on the sheet for forming an image such as a transfer sheet.

Also, if necessary, it is possible to provide a design effect as well as identification ability of product forgery on the sheet for forming an image.

What is claimed is:

1. A sheet for forming an image comprising a substrate film and two or more image-formative layers disposed thereon, the image-formative layers being defined by frame respectively and arranged in a longitudinal direction of the substrate film, wherein an identifying mark comprising a sequence of mark bits which records information concerning the sheet for forming an image is provided to the sheet for forming an image in a manner of allocating respective mark bits to unit frames each of which comprises a single frame or plural frames of the image-formative layer with the mark bits being arranged in order of the sequence recording the information with at least one cycle period comprising a certain number of the unit frames along with a longitudinal direction of the sheet for forming an image, and wherein the sequence of the mark bits constituting the identifying mark is a combination of a sequence of mark bits constituting a first mark A with a sequence of mark bits constituting a second mark B, the first mark A having a cycle period of a natural number X, the second mark B having a cycle period of a natural number Y different from said X and relatively prime with said X, and the first mark A and the second mark B being different from each other.

2. A sheet for forming an image according to claim 1, wherein the identifying mark is an optically detectable mark, and the first mark A and the second mark B have different optical property for detection.

3. A sheet for forming an image according to claim 1, wherein the sequence of mark bits constituting the identifying mark is a combination of the sequence of mark bits constituting the first mark A, the sequence of mark bits constituting the second mark B, and a sequence of mark bits constituting a third mark C, the third mark C having a cycle period same as the natural numbers X or Y or of a natural number Z different from said X and Y and relatively prime with said X and Y, and the first mark A, the second mark B and the third mark C being different from each other.

4. An image forming method using the sheet of claim 1 said image forming method comprising steps of:

detecting an identifying mark of the sheet for forming an image; and identifying the sheet for forming an image based on a detecting result of the detecting step.

5. The image forming method of claim 4 wherein, in the detecting step, at least one cycle of the mark bits of the identifying mark are detected while carrying the sheet for forming an image to a forward or a reverse direction.

6. An image forming apparatus using the sheet of claim 1 said apparatus comprising:

a means for detecting an identifying mark of the sheet for forming an image; and a means for identifying the sheet for forming an image based on a detecting result of the means for detecting.

7. An image forming apparatus according to claim 6 wherein the means for detecting the mark bits detects at least one cycle of the mark bits of the identifying mark while carrying the sheet for forming an image to a forward or a reverse direction.

8. A sheet for forming an image comprising a substrate film and two or more image-formative layers disposed thereon, the image-formative layers being defined by frame respectively and arranged in a longitudinal direction of the substrate film, wherein an identifying mark comprising a sequence of mark bits which records information concerning the sheet for forming an image is provided to the sheet for forming an image in a manner of allocating respective mark bits to unit frames each of which comprises a single frame or plural frames of the image-formative layer with the mark bits being arranged in order of the sequence recording the information with at least one cycle period comprising a certain number of the unit frames along with a longitudinal direction of the sheet for forming an image, and wherein the sequence of the mark bits constituting the identifying mark is a combination of a sequence of mark bits constituting a first mark A with a sequence of mark bits constituting a second mark B, the first mark A having a cycle period of a natural number X, the second mark B having a cycle period same as said X, and the first mark A and the second mark B being different from each other in sequence of the mark bits per one cycle period along with the longitudinal direction.

9. A sheet for forming an image according to claim 8, wherein the sequence of mark bits constituting the identifying mark is a combination of at least three sequences of mark bits including those of the mark A and the mark B, each of the sequences constituting a separate series of mark form each other, wherein each mark has a cycle period of a natural number same as any one of the other mark, and the all the marks are different from each other in sequence.

10. An image forming method using the sheet for forming an image of claim 8 comprising steps of:

detecting an identifying mark of the sheet for forming an image; and identifying the sheet for forming an image based on a detecting result of the detecting step.

11. An image forming apparatus using the sheet for forming an image of claim 8 comprising:

a means for detecting an identifying mark of the sheet for forming an image; and a means for identifying the sheet for forming an image based on a detecting result of the means for detecting.

* * * * *